US005953782A

United States Patent [19]

Vogel et al.

[11] Patent Number: 5,953,782

[45] Date of Patent: Sep. 21, 1999

[54] CUTTING HEAD FOR A PIPE CLEANING ASSEMBLY

[76] Inventors: Werner Vogel; Walter Gilles, both of Düsseldorf, Germany

[21] Appl. No.: 09/044,646

[22] Filed: Mar. 19, 1998

[51] Int. Cl.[6] ..... B08B 9/02

[52] U.S. Cl. ..... 15/104.09; 15/104.095; 15/104.31

[58] Field of Search ..... 15/104.05, 104.09, 15/104.095, 104.096, 104.11, 104.12, 104.13, 104.14, 104.31, 104.33

[56] References Cited

U.S. PATENT DOCUMENTS

| | | | |
|---|---|---|---|
| 1,386,249 | 8/1921 | Gander | 15/104.09 |
| 1,881,821 | 10/1932 | McCracken | 15/104.14 |
| 2,057,842 | 10/1936 | Nielsen | 15/104.09 |
| 2,236,468 | 3/1941 | Crane | 15/104.33 |
| 2,275,850 | 3/1942 | Gardner | 15/104.33 |
| 5,418,997 | 5/1995 | DeFrange | 15/104.095 X |

FOREIGN PATENT DOCUMENTS

| | | | |
|---|---|---|---|
| 336358 | 1/1904 | France | 15/104.05 |
| 215815 | 11/1909 | Germany . | |
| 174224 | 1/1922 | United Kingdom . | |
| 1047147 | 11/1966 | United Kingdom . | |

*Primary Examiner*—Mark Spisich
*Attorney, Agent, or Firm*—Herbert Dubno

[57] ABSTRACT

Described is a cutting head for a pipe cleaning assembly. The cutting head has a cutting head housing and at least two cutting head blades pivotally supported at the cutting head housing in the manner of scissors and biassed into a spreaded normal position. The cutting blades are movable radially inwardly by the lateral application of force against the biassing action approximately until a position of coincidence. Such a cutting head adapts itself in an especially good manner to the grade of clogging of the respective pipe on account of the flexible support of the two cutting blades.

9 Claims, 3 Drawing Sheets

FIG. 2
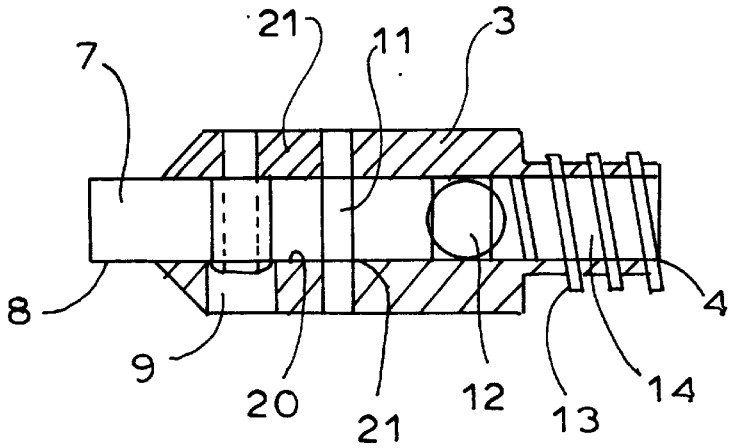
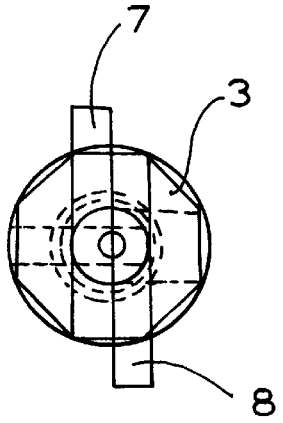
FIG. 3
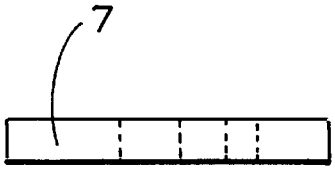
FIG. 7
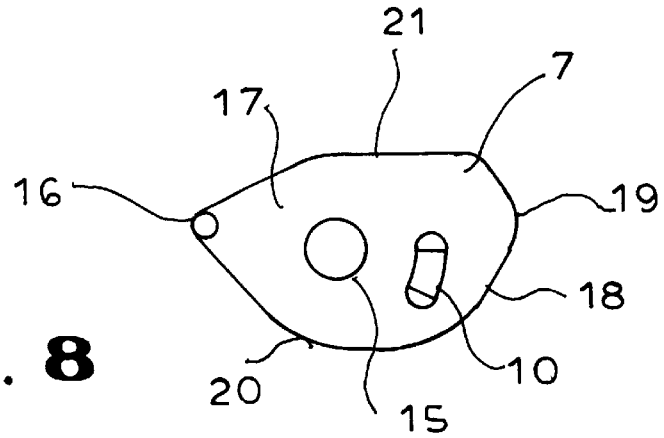
FIG. 8

CUTTING HEAD FOR A PIPE CLEANING ASSEMBLY

FIELD OF THE INVENTION

The present invention is directed to a cutting head for a pipe cleaning assembly.

BACKGROUND OF THE INVENTION

It is known to use pipe cleaning assemblies for removing obstructions of pipes, drain channels etc. These assemblies have a drive machine as well as a power transmission line emanating herefrom with which a drilling head or cutting head is rotated. The drilling head or cutting head, which is known in a plurality of embodiments, is introduced into the clogged pipe and is rotated. Upon rotation it drills or cuts through the clogged pipe portion so that the cross-section of the pipe is opened again. Known are, for instance, club-shaped drills, funnel-shaped drills, toothed drills, cutting heads etc.

It is known to associate a pipe cleaning assembly with a plurality of such drilling heads or cutting heads in order to use differently shaped drilling heads or cutting heads dependent on the kind of occlusion to be removed. Accordingly, the known drilling heads or cutting heads are relatively inflexible with respect to their field of application.

OBJECT OF THE INVENTION

The object of the present invention is to provide a cutting head of the cited kind which adapts itself especially well to the kind of occlusion or the grade of occlusion of the pipe which is to be cleaned.

SUMMARY OF THE INVENTION

According to the invention this problem is solved by a cutting head for a pipe cleaning assembly which comprises a cutting head housing and at least two cutting head blades which are pivotally supported at the cutting head housing for scissor action wherein the cutting head blades are biassed into a spread normal position and are radially inwardly movable approximately into a position of coincidence by lateral application of force against the biassing effect.

Accordingly, the inventive solution substitutes for a rigidly formed cutting head a flexibly formed cutting head with at least two cutting blades thereof being able to assume different radial positions dependent on the degree and kind of occlusion. In the normal position at least two cutting head blades are in a spread position so that, like with a pair of scissors, their tips and ends are spaced from one another, respectively. Accordingly, in this position the spread tips and ends of the cutting blades can do cutting work and the tool formed by the two cutting blades covers a relatively large cross-sectional area on account of the spread blades. Such a condition is realized by the cutting blades especially if the degree occlusion of the corresponding pipe is not large, i.e. occlusions are present only at the pipe walls while the center of the pipe is still open. In this case the two cutting blades are not pressed radially inwardly. In this condition with "extended" cutting blades a cutting is preferably carried out radially outside, the cutting being carried out while the head is moved both forward and backward.

If a small resistance is laterally applied to the "extended" cutting blades the same are pressed radially inwardly. By this movement, the two tips of the cutting blades are moved closer. Then the cutting is realized with the tips and the radial outer portions and can be carried out with movement of the head forward and backward, too. Here, the cutting blades are approximately in a center position.

If the cutting blades are subject to an especially strong lateral resistance they are pivoted radially inwardly so far that they approximately take a position of coincidence or even their tips move from one another again. In this condition in which the cutting head is especially slim the cutting is substantially carried out only with the tip and only in a forward direction of movement of the head.

If the cutting head according to the invention comes into contact with an occlusion of a pipe it first cuts into the clogged region with its tip wherein the two blades are pivoted into the "retracted" inner position in which the cutting head has its smallest width by the pressure applied laterally with respect to the clogged region. Dependent on the releasing lateral pressure on the cutting blades the same automatically spread radially outwardly so that the occlusion can be also cut with the radial lateral portions of the blades in addition to the tip. Finally, the blades arrive at their completely "extended" position in which the occlusion is cut only with the radial outer portions of the blades. Accordingly, the cutting head adapts itself very well to the respective conditions of the occlusion so that an especially high efficiency with respect to the removal of pipe occlusions can be achieved.

It is essential with the inventive solution that the cutting blades are resiliently biassed into their spread normal position and are resiliently movable radially inwardly by the application of lateral pressure until the blades approximately reach their position of coincidence and the cutting head can assume an especially slim form. When the laterally applied pressure is released the blades automatically move outwardly again until they possibly reach their outwardly spread normal position.

Accordingly, the cutting head formed according to the invention can take the form of a cone in the completely spreaded position of the cutting blades and can cut with the radial outer edges of the blades or can take a slim form, for instance the same of a cylinder, and can axially cut with the tips of the blades. As mentioned above, intermediate forms are possible in accordance with the respective circumstances.

Dependent on the spreading position of the blades the cutting head can also work in a backward direction of movement of the head. For instance the head can be moved forward and backward. On account of the resilient support of the cutting blades an especially good adaption to the kind of obstruction and to the grade of obstruction of the pipe is realized.

The housing of the cutting head can be cylindrical or polygonal, for instance. A polygonal shape is especially favorable when a pressure flushing which is to be carried out.

In accordance with a preferred embodiment of the invention the housing of the cutting head has a longitudinal slot for receiving the cutting head blades and includes two arms confining the slot and containing the pivot bearing for the cutting head blades. Practically, the slot extends centrally through the cutting head housing emanating from one end of the same. Accordingly, the cutting head blades are centrally supported in the housing and are taken up by the provided slot. Dependent on their spread condition they laterally project from the housing. Moreover, the tips of the cutting blades project beyond the front side of the housing.

Preferably, the cutting head housing has a stop determining the spread normal position of the cutting blades. This stop is preferably formed by a pin projecting from the arms of the cutting head housing and extending through guide slots of the cutting blades. In the spread normal position of the cutting blades the pin engages one end of the slot of the one blade and the opposite end of the slot of the other blade so that a further movement of the blades radially outwardly is prevented. A radial movement inwardly is possible wherein the pin moves through the slot until it reaches the other end of the slot whereby the innermost position of the blades is determined.

Practically, the cutting head housing has at its rear end a thread for connecting a flexible force transmitting line which realizes the connection to the drive machine of the cutting head. In this manner the cutting head can be rotated. The kind of force transmission is of no importance for the present invention.

According to a prefered embodiment of the invention a spring disposed within a recess of the cutting head housing is provided as biassing means. The spring presses a ball guided in the recess against the rear side of the two cutting blades. In the spread normal position of the cutting blades the ball engages between the two spreaded blades and biasses the same into the spread position. If the blades are radially pressed together the ball is again pressed into the recess against the force of the spring.

As regards the constitution of the cutting head blades themselves, the same are formed like lamellas, discs or plates and have preferably a triangular forward portion. The same has a triangular tip which serves as cutting tip. Furthermore, the lateral edges of the blades serve as cutting edges.

Preferably, the cutting head blades have a curved rear side in order to enable the sliding of the ball serving as biassing means there against if the blades move radially inwardly. The cutting blades are thus pressed radially inwardly without problems. Furthermore, the radial inner portion of the curved rear side of the cutting blade has a flatter curvature than the radial outer portion. Accordingly, when the blades are pressed inwardly the ball runs along the flatter curvature until a position shortly in front of the end of the flatter curved portion. In this position the blades have approximately a position of coincidence. There the ball is confined on both sides by portions of the curved rear side of the two blades which project even further to the rear.

BRIEF DESCRIPTION OF THE DRAWING

The above and other objects, features, and advantages will become more readily apparent from the following description, reference being made to the accompanying drawing in which:

FIG. 2 is an axial section through the cutting head of FIG. 1 perpendicular to the plane of the paper;

FIG. 3 is a front view of the cutting head of FIGS. 1 and 2;

FIG. 7 is a top view of a cutting blade; and

FIG. 8 is a lateral view of the cutting blade of FIG. 7.

Figure 1:
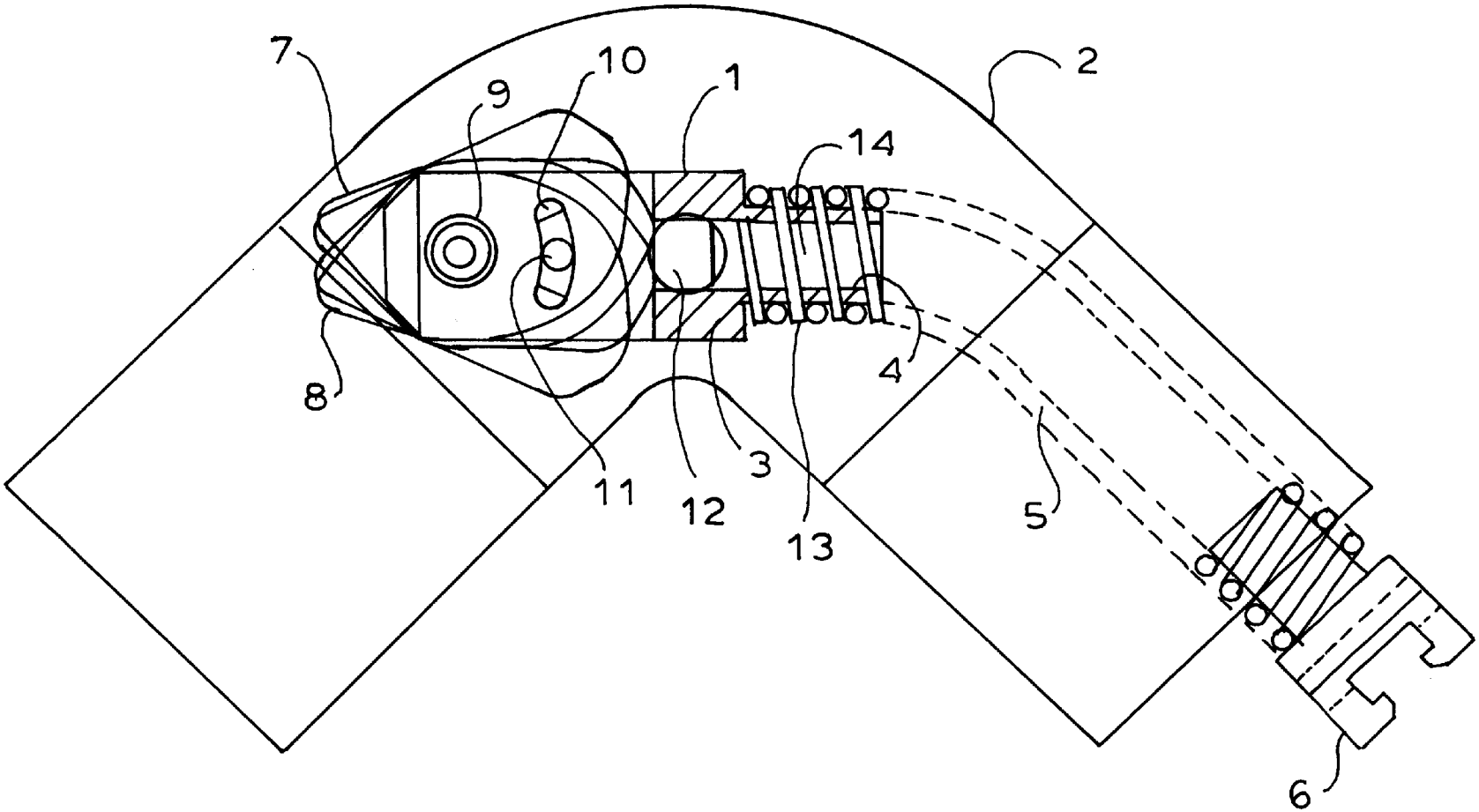
FIG. 1 is a diagrammatic elevational view, partly broken away which shows the forward portion of a pipe cleaning assembly with cutting head within a pipe bend.

The forward portion of a pipe cleaning assembly shown in FIG. 1 comprises a cutting head 1, an adapter spring 5 connected herewith and a coupling 6 connected hereto. The adapter spring is connected to the cutting head by means of a thread 4 disposed at the rear end of the cutting head 1. The pipe cleaning assembly has a drive machine (not shown) which is connected to a force transmitting line (not shown) which is adapted to be connected to the coupling 6. The drive machine rotates the cutting head 1 through the force transmitting line, the coupling 6 and the adapter spring 5.

With such a cutting head 1 obstructions in pipes can be removed. Such a pipe with a bend is shown at 2.

The cutting head 1 itself has a cutting head housing 3 which can be recognized best in FIG. 2. The cutting head housing 3 has a longitudinal slot 20 extending from the left end of the housing in the figure towards the right side into the housing. The slot 20 is laterally confined by two housing arms 21. Two cutting blades 7, 8 are disposed within the slot parallel with respect to one another and in contact with one another. These two cutting blades 7, 8 are pivotally supported within the cutting blade housing 3 through a pivot pin 9 extending by the two housing arms 21 and corresponding bores in the two cutting blades 7, 8.

Furthermore, a stop pin 11 extends through corresponding bores in the housing arms 21 and a respective slot 10 in each cutting blade 7, 8. This slot is curved, as shown in FIG. 1. In the position of the blades 7, 8 as shown in FIG. 1 the stop pin 11 abuts against the left end of the slot 10 of the one blade and against the right end of the slot of the other blade. Accordingly, the blades are held in the shown spreaded position by the pin 11 and cannot move further outwardly.

Furthermore, a dead end bore 13 in which a compression coil spring 14 is disposed is located in the rear end of the cutting head housing 3. The compression coil spring 14 pushes a ball 12 to the left in FIGS. 1 and 2 against the rear sides of the two blades 7, 8. The blades are thus biassed into the spreaded position shown in FIG. 1. When a radially inwardly directed force is applied to the two blades the same can be resiliently pressed radially inwardly whereby the ball 12 is pushed into the recess 13 against the action of the spring 14. If pressure is no longer applied to the blades, the ball 12 moves again to the left in FIG. 1 and presses the blades again into the spread position shown in FIG. 1.

FIG. 3 shows a front view of the cutting head wherein the spreaded position of the blades 7, 8 shown in FIG. 1 can be recognized.

Figure 4:
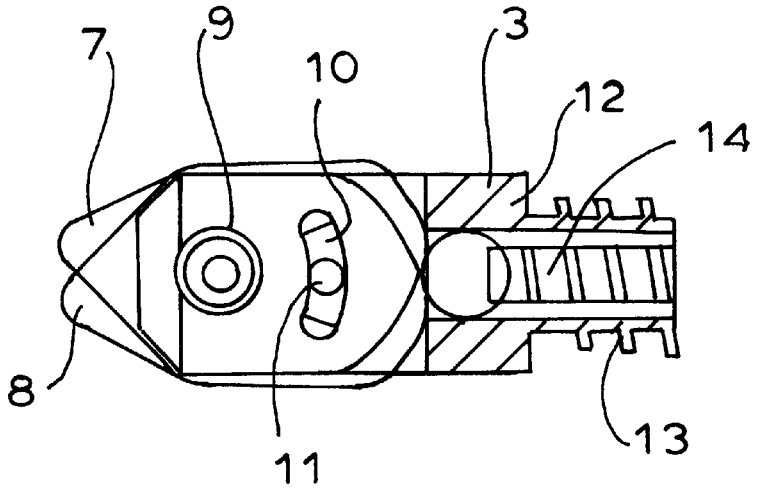
FIG. 4 is a vertical section through the cutting head of FIGS. 1–3 in a first position of the cutting blades.
Figure 5:
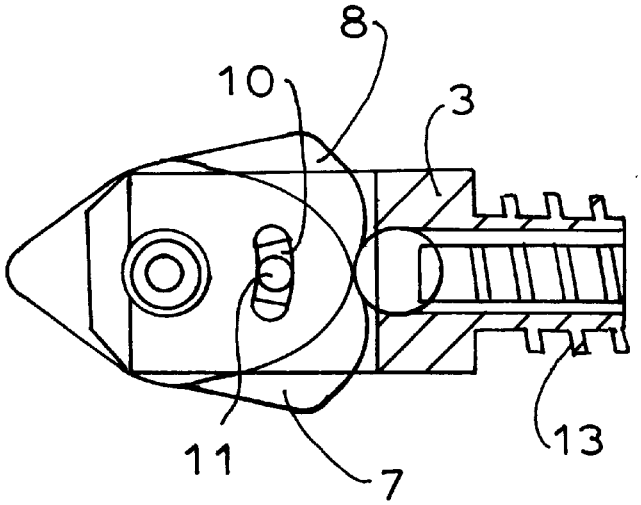
FIG. 5 is a vertical section through the cutting head in a second position of the cutting blades.
Figure 6:
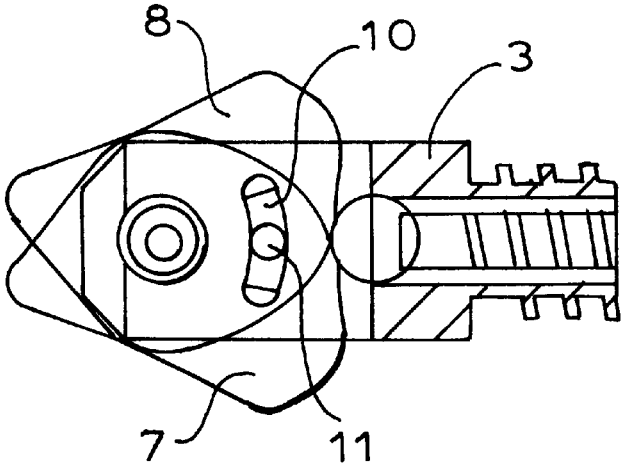
FIG. 6 is a vertical section through the cutting head in a third position of the cutting blades.

FIGS. 4–6 show three vertical axial sections through the cutting head of FIGS. 1–3 parallel to the plane of the cutting blades. FIG. 4 shows the case in which the two blades 7, 8 have been moved radially inwardly and assume an approximate position of coincidence, however, wherein only the two blade tips deviate from one another. One recognizes that the ball 12 engages between the blades. The pin 11 is in the opposite abutment position with respect to FIG. 1. FIG. 5 shows a central position according to which the two blades have been slightly spread outwardly. Here, the ball 12 has moved in FIG. 5 further to the left between the blades. The pin 11 does not act as a stop within the slot confines.

FIG. 6 shows the blades 7, 8 in the normal spreaded position in which the pin 11 acts as a stop within the slot and thus prevents a further movement of the blades radially outwardly. Again, the ball 12 engages between the blades.

FIG. 7 shows a top view of the cutting blade 7 which is formed as flat disc. FIG. 8 shows a lateral view of the blade 7. This has a tip 16 and a triangular forward portion 17 merging into a rear portion which is confined by two parallel edges 30 and a curved rear edge. The curved rear edge has a portion 18 with flatter curvature merging into a portion with larger curvature 19 from which a nearly linear portion merges into the linear edge 31. According to the positions shown in FIGS. 4–6 the ball 12 is contact with the portion 18 with flatter curvature, and the portion 19 with larger curvature prevents the ball from sliding off the blade. The curvature of the portions 18 and 19 is selected in such a manner that the blades automatically move back into their spread normal position if no more radial pressure is applied.

Only by the flexible arrangement of the cutting blades is it possible to cut free a smaller cross-section during forward operation which makes it possible to carry out the main cutting process during the rearward operation with the assistance of flushing water. This has the inventive advantage that the deposits are moved away from below to above without clogging the pipe again. Only this kind of cutting with reinforced radial pressure during backward operation ensures optimum efficiency in one operation step.

We claim:

1. A cutting head for a pipe cleaning assembly comprising:

a cutting head housing; and at least two cutting blades pivotally supported on the cutting head housing for scissors movement thereon; and means for biasing said blades into a spread normal position and enabling movement of the blades radially inwardly by the lateral application of force against an action of the means for biasing approximately until a position of substantial coincidence of the blades is reached.

2. The cutting head according to claim 1 wherein the cutting head housing has a longitudinal slot for receiving the cutting blades and two arms confining the slot and provided with a pivot bearing for pivotally supporting the cutting blades.

3. The cutting head according to claim 2 wherein the cutting head housing has a stop which establishes the spread normal position of the cutting blades.

4. The cutting head according to claim 3 wherein the stop is formed by a pin in the arms of the cutting head housing and extending through guide slots formed in the cutting blades.

5. The cutting head according to claim 1 wherein the cutting head housing has a thread at a rear end thereof for the connection of a flexible force transmission line thereof.

6. The cutting head according to claim 1 wherein said means for biasing comprises a spring disposed in a recess of the cutting head housing, said spring pressing a ball guided in the recess against the rear side of the two cutting blades.

7. The cutting head according to claim 1 wherein the cutting blades have triangular forward portions.

8. The cutting head according to claim 1 wherein the cutting blades have curved rear sides.

9. The cutting head according to claim 8 wherein radial inner portions of the curved rear sides of the cutting blades have flatter curvatures than respective radial outer portions thereof.

* * * * *